US005709583A

United States Patent [19]

Suto et al.

[11] Patent Number: 5,709,583

[45] Date of Patent: Jan. 20, 1998

[54] STEERING SYSTEM FOR RADIO-CONTROLLED WHEELED VEHICLE TOY

[75] Inventors: Shohei Suto, Tokyo, Japan; Jonathan Adam Jaffe, Voorhees, N.J.

[73] Assignee: Tyco Industries, Inc., Mount Laurel, N.J.

[21] Appl. No.: 484,867

[22] Filed: Jun. 7, 1995

[30] Foreign Application Priority Data

Jul. 27, 1994 [JP] Japan ..... 6-193787

[51] Int. Cl.[6] ..... A63H 17/21

[52] U.S. Cl. ..... 446/440; 446/456; 446/460

[58] Field of Search ..... 446/440, 456, 446/460, 468

[56] References Cited

U.S. PATENT DOCUMENTS

| | | | |
|---|---|---|---|
| Re. 30,299 | 6/1980 | Greenwood . | |
| 2,159,974 | 5/1939 | Lohr . | |
| 2,699,011 | 1/1955 | Sedgwick . | |
| 2,814,908 | 12/1957 | Ernst . | |
| 2,829,467 | 4/1958 | Pagano . | |
| 3,546,814 | 12/1970 | Melendez . | |
| 3,650,067 | 3/1972 | Greenwood . | |
| 3,756,338 | 9/1973 | Goodridge . | |
| 3,840,086 | 10/1974 | Burton | 446/460 |
| 3,886,682 | 6/1975 | Ieda et al. . | |
| 4,143,307 | 3/1979 | Hansen et al. | 446/454 |
| 4,171,592 | 10/1979 | Saitoh | 446/456 |
| 4,201,011 | 5/1980 | Cook . | |
| 4,267,663 | 5/1981 | Nagahara . | |
| 4,290,228 | 9/1981 | Goldfarb et al. . | |
| 4,309,841 | 1/1982 | Asano . | |
| 4,342,175 | 8/1982 | Cernansky et al. . | |
| 4,363,186 | 12/1982 | Goldfarb et al. . | |
| 4,383,388 | 5/1983 | Suimon . | |
| 4,387,532 | 6/1983 | Suimon . | |
| 4,471,566 | 9/1984 | Ishimoto | 446/456 |
| 4,526,554 | 7/1985 | Goldfarb et al. | 446/429 |
| 4,568,306 | 2/1986 | Martin | 446/437 |
| 4,571,213 | 2/1986 | Ishimoto | 446/460 |
| 4,601,674 | 7/1986 | Koizumi | 446/440 |
| 4,705,487 | 11/1987 | Ishimoto | 446/290 |
| 4,712,806 | 12/1987 | Patrin | 280/217 |
| 4,764,149 | 8/1988 | Yoneyama | 446/440 |
| 4,881,917 | 11/1989 | Suzuki et al. | 446/468 |
| 4,902,271 | 2/1990 | Yoneda | 446/440 |
| 4,966,569 | 10/1990 | Asano | 446/440 |
| 5,269,718 | 12/1993 | Reed | 446/440 |
| 5,368,516 | 11/1994 | Hoeting et al. | 446/456 |

FOREIGN PATENT DOCUMENTS

| | | | |
|---|---|---|---|
| 1 039 898 | 9/1958 | Germany . | |
| 43 24 774 | 1/1995 | Germany . | |
| 56-13971 | 2/1981 | Japan . | |
| 62-107891 | 7/1987 | Japan . | |
| 2-65992 | 5/1990 | Japan . | |
| 747701 | 4/1956 | United Kingdom | 446/456 |
| 2 087 739 | 6/1982 | United Kingdom . | |
| 2 199 257 | 7/1988 | United Kingdom . | |

*Primary Examiner*—Robert A. Hafer
*Assistant Examiner*—Jeffrey Carlson
*Attorney, Agent, or Firm*—Panitch Schwarze Jacobs & Nadel, P.C.

[57] ABSTRACT

A radio-controlled vehicle toy is disclosed which includes a body, a caster axle mounted on a front end of the body and tilted backward from vertical, a front fork rotatable on the caster axle and rotatably supporting a front vehicle wheel, a rear-wheel drive coupled with a rear vehicle wheel, a radio-control receiver and a power source mounted to the body, and a pair of auxiliary wheels mounted on opposite sides of the vehicle body frame so as to be brought into contact with an underlying surface when the vehicle body frame leans laterally. A steering unit is mounted in a front-end portion of the body and includes a steering mechanism to rotate the front fork based on a control signal issued from the receiver and a resilient coupling which resiliently applies control torque to the front fork. The rear-wheel drive includes a motor which receives an electric current from the power source a speed reduction unit between the motor and the rear wheel, and a switch coupled across the motor, the switch being operable according to a signal initiated by the vehicle receiver to close and short the motor, which exerts a drag to effectively brake the vehicle toy.

16 Claims, 9 Drawing Sheets

STEERING SYSTEM FOR RADIO-CONTROLLED WHEELED VEHICLE TOY

BACKGROUND OF THE INVENTION

1. Field of the Invention

The present invention relates to a steering system for a radio-controlled wheeled vehicle toy, and more particularly to a steering system particularly suited to a radio-controlled wheeled vehicle toy remotely controlled in travel direction.

2. Description of the Prior Art

Conventional steering systems of the remotely-controlled wheeled vehicle toys are generally classified into two well-known types: one of which causes a front fork portion of the vehicle toy to turn right and left so that the center of gravity of the vehicle toy is displaced; and the other of which types causes a predetermined weight element (for example, such as an electric power unit and the like mounted to a body of the vehicle toy) to swing right and left so that the center of gravity of the vehicle toy is displaced.

However, the conventional steering systems having the above constructions present certain difficult problems. The wheeled vehicle toy, which is provided with any one of the conventional steering systems having the above constructions, depends on the displacement of the center of gravity of the vehicle toy when the vehicle toy makes turns. On the other hand when the vehicle toy travels at high speed, the vehicle toy is subjected to a large force to keep the course of the vehicle toy straight, which force acts adversely on a turning effort of the vehicle toy to seriously impair the vehicle toy in maneuverability.

In addition, any one of the conventional steering systems having the above constructions requires a large force to realize the displacement of the center of gravity of the vehicle toy in making turns, and therefore requires a servo-mechanism comprising a motor, reduction gears and an electric circuit for controlling a steering angle of the vehicle toy, which increases the manufacturing cost and typically the weight of the steering system of the vehicle toy.

SUMMARY OF THE INVENTION

It is an object of the present invention to provide a steering system of a radio-controlled wheeled vehicle toy, which is small in the number of its parts, easy in assembly operations thereof and excellent in maneuverability. More particularly, in one aspect the present invention is embodied by a generally longitudinal vehicle body frame, a caster axle mounted on a front end of the vehicle body frame and tilted backward from vertical, a front fork rotatable on the caster axle and rotatably supporting a front wheel, a rear-wheel drive drivingly coupled with a rear wheel, a radio-control receiver and an electric power source mounted to the vehicle body frame, and auxiliary wheels mounted on opposite sides of the vehicle body frame so as to be brought into contact with the ground when the vehicle body frame leans laterally. A steering system is mounted in a front-end portion of the vehicle body frame. The steering system has a steering mechanism which produces a control torque for rotating the front fork based on a control signal issued from the receiver, and a resilient mechanism to resiliently transmit the control torque to the front fork.

In another aspect, the invention is a radio-controlled, wheeled vehicle toy comprising: a vehicle body frame; a radio-control receiver and an electric power source both mounted to the vehicle body frame; at least two vehicle wheels rotatably supported by the vehicle body frame; a motor; a rotational coupling between the motor and at least one of the vehicle wheels; and a switch positioned across the motor and operable according to a signal initiated by the receiver, the signal closing the switch and shorting the motor, the shorted motor exerting a drag on the linkage and the at least one of the vehicle wheels to effectively brake the vehicle toy.

In yet another aspect, the invention is a radio-controlled wheeled vehicle toy comprising: a generally longitudinal vehicle body frame; a caster axle mounted on a front end of the vehicle body frame and tilted backward from vertical; a front fork rotatable on the caster axle and rotatably supporting a front vehicle wheel; an electric drive coupled with a rear vehicle wheel; a radio-control receiver and an electric power source both mounted to the vehicle body frame; and a steering system mounted in a front-end portion of the vehicle body frame and having: a steering mechanism which produces a control torque based on a control signal issued from the receiver; and a resilient coupling between the steering mechanism and the front fork.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DESCRIPTION OF THE PREFERRED EMBODIMENTS

Figure 1:
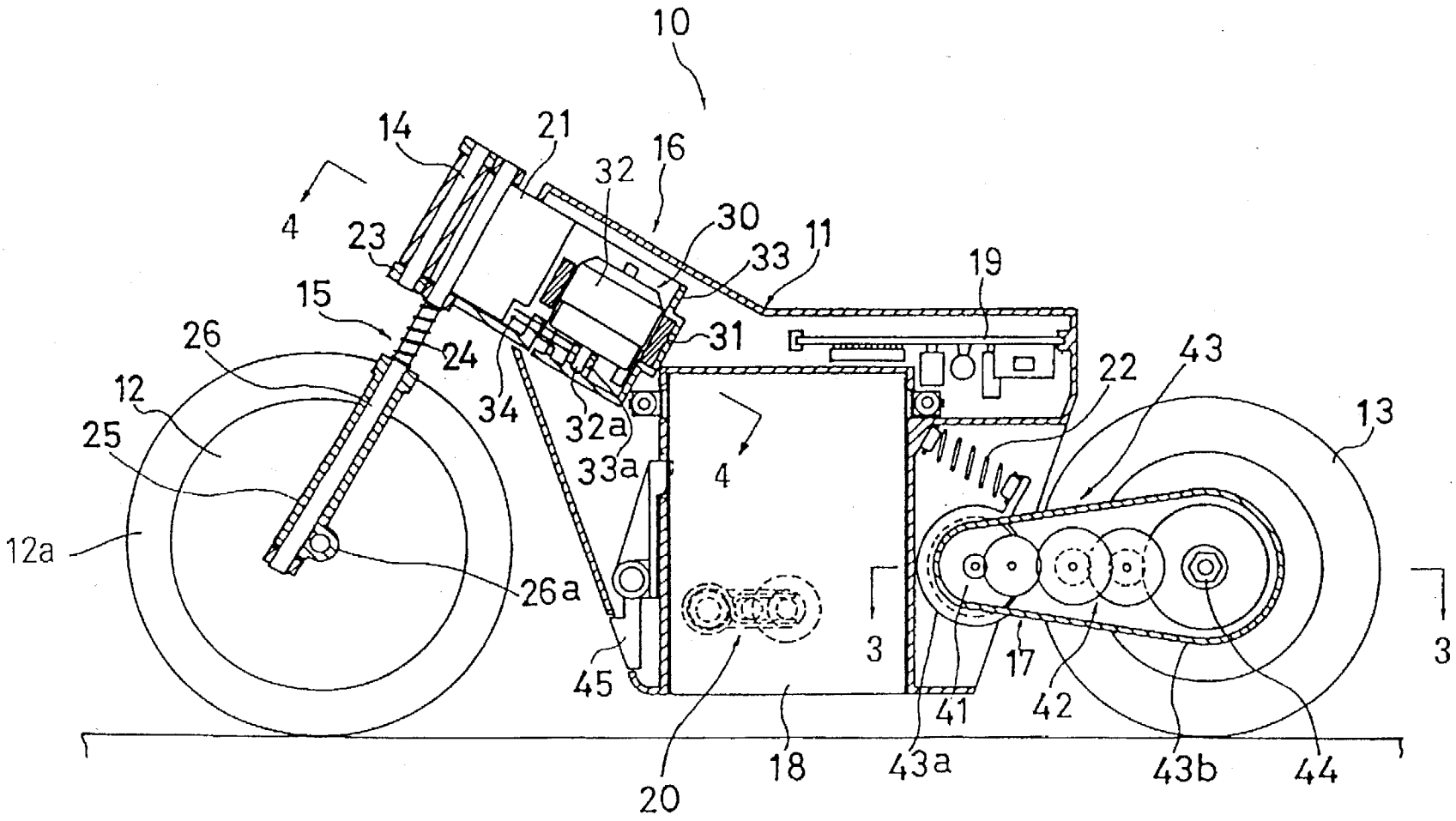
FIG. 1 is a longitudinal sectional side view of a the wheeled vehicle toy constructed in accordance with a first embodiment of the present invention.

Certain terminology may be used in the following description for convenience only and is not limiting. For example, the words "left", "right", "upper", and "lower" designate directions in the drawings to which reference is made, and the words "inwardly" and "outwardly" are further directions toward and away from, respectively, the geometric center of a referenced object. The terminology includes the words above specifically mentioned, derivatives thereof, and words of similar import.

Figure 2:
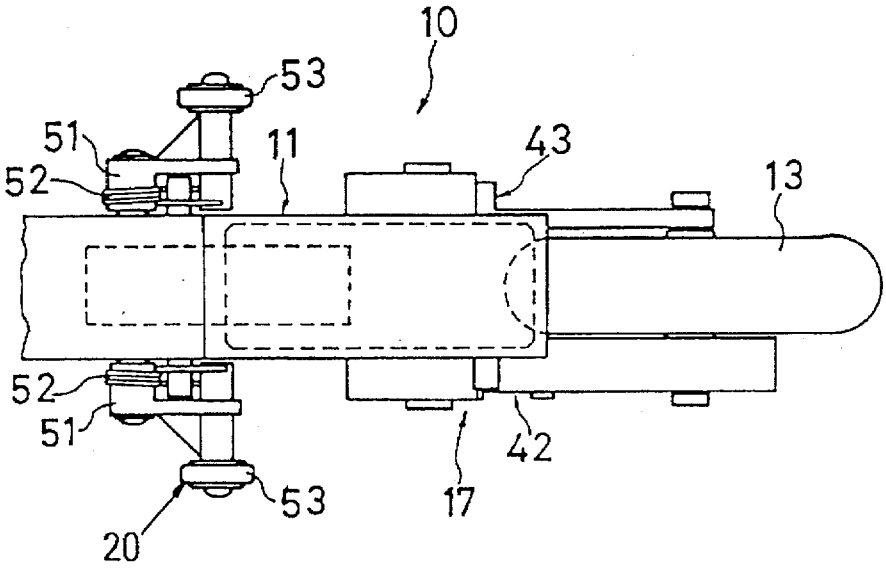
FIG. 2 is a plan view of a central portion of the vehicle toy of FIG. 1.
Figure 3:
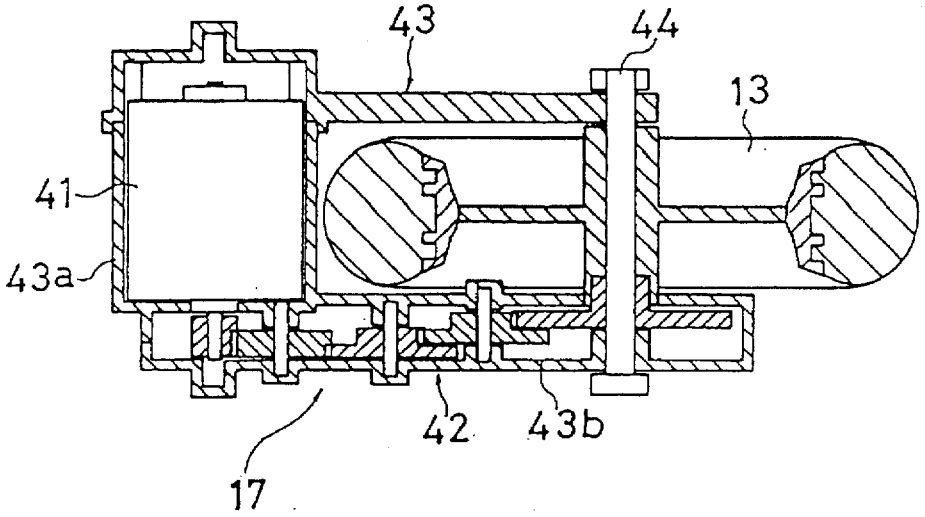
FIG. 3 is an enlarged cross-sectional view taken along the line 3—3 of FIG. 1.

Referring to the drawings in detail, wherein like numerals are used to indicate like elements throughout, there is shown in FIGS. 1–4 a first embodiment of a wheeled vehicle toy of the present invention, wherein FIG. 1 shows a longitudinal sectional side view of the vehicle toy; FIG. 2 a plan view of the vehicle toy, looking from the rear of the vehicle (right side) of FIG. 1; FIG. 3 an enlarged cross-sectional view of the vehicle toy, taken along the line 3—3 of FIG. 1; and FIG. 4 an enlarged cross-sectional view of the vehicle toy, taken along the line 4—4 of FIG. 1. Incidentally, a handle bar, a rider, and like parts, which do not relate to the present invention, will be omitted in the following description.

As shown in FIG. 1, a preferred embodiment radio-controlled two-wheeled vehicle toy 10 of the present invention comprises: a vehicle body frame 11; a front wheel 12 and a rear wheel 13 mounted on a front and a rear portion of the vehicle body frame 11, respectively; a front fork 15 which is rotatable on a caster axle 14 mounted on a front-end portion of the vehicle body frame 11 so as to be tilted backward from the vertical, and rotatably supports the front wheel 12; a steering unit 16 for controlling the front fork 15 in direction; an electric rear-wheel drive 17 coupled with the rear wheel 13 for driving the rear wheel 13; a preferably removable electric power source 18, which might be a single battery of one or more cells or several separate batteries wired and bound together in a pack to act in common; a radio-control receiver 19 for controlling both the steering unit 16 and the rear-wheel drive portion 17; and an auxiliary wheel unit indicated generally at 20 provided with a pair of auxiliary wheels 53 mounted on opposite sides of the vehicle body frame 11, which are brought into contact with the ground when the vehicle body frame 11 leans sideways from the vertical by a predetermined angle.

The vehicle body frame 11 preferably is made of plastics and like light, strong materials, assumes a narrow box-like shape having its front portion tilted slightly upward, and is divided into three sections; a central one for receiving the power source 18 therein; an rear one (which is partially disposed over the central one) for receiving a circuit board of the receiver 19 therein; and a front one (i.e., front portion slightly tilted upward from the remainder of the vehicle body frame 11) for receiving the steering unit 16 therein. Projected forward from the front-end portion of the vehicle body frame 11 is an arm portion 21 of a casing 33 of the steering unit 16 described later. The arm portion 21 is integrally formed with the casing 33. The caster axle 14 is mounted in a front-end portion of the arm portion 21 of the casing 33 so as to be tilted backward from the vertical by an angle of, for example, 30 degrees. The electric rear-wheel drive 17 is mounted on a lower area of the rear portion of the vehicle body frame 11 through a buffer spring 22 which absorbs shocks caused by irregularities in the road and the like through the rear wheel 13.

Front wheel 12 preferably includes a solid, relatively dense rubber tire **12*a*, which, by virtue of its heavy weight along the outer edge of the wheel 12, provides a gyroscopic effect when the wheel 12 rotates. As may be understood, the gyroscopic effect provided affords stability and balance to the vehicle toy 10** while it is moving.

Figure 4:
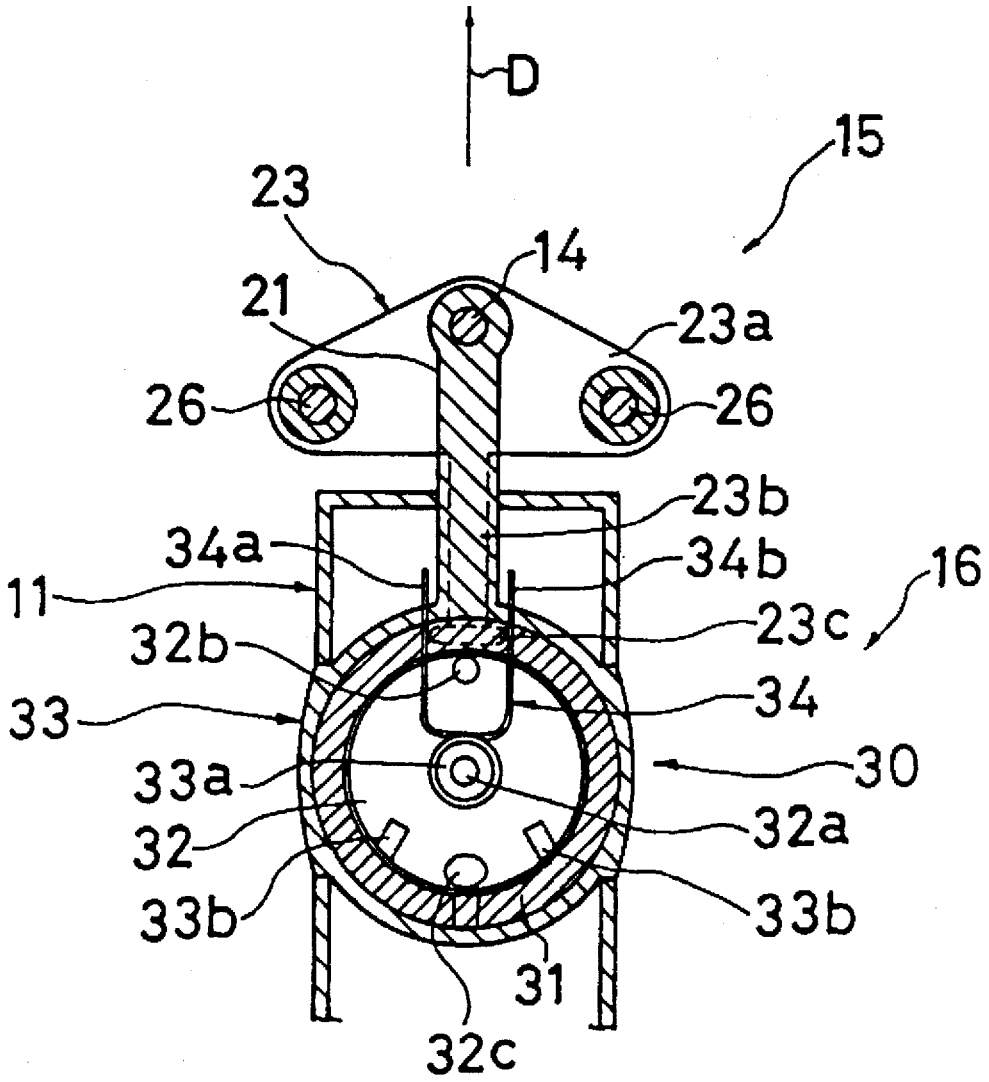
FIG. 4 is an enlarged cross-sectional view taken along the line 4—4 of FIG. 1.

As is clear from FIG. 1, the front fork 15 is constructed of a fork holder 23, a pair of parallel springs 24, a pair of parallel outer pipes 25, and a pair of parallel inner shafts 26. As shown in FIG. 4, the fork holder 23 is provided with: a shaft-mounting portion **23*a* for fixedly mounting the inner shafts 26 therein, which portions 23*a* assumes a substantially-triangular flat plate-like shape; a handle arm portion 23*b* projecting rearward from a central area of the shaft-mounting portion 23*a*; and an abutting portion 23*c* formed in a rear-end area of the handle arm portion 23*b*. The shaft-mounting portion 23*a* of the fork holder 23 has its front-end portion mounted on the caster axle 14 so as to be rotatable thereon. The pair of parallel inner shafts 26 are fixedly mounted on the opposite rear ends of the shaft-mounting portion 23*a* so as to be symmetrically arranged with respect to the center line of the shaft-mounting portion 23*a*. Each of the parallel inner shafts 26 has its lower portion slidably mounted in each of the parallel outer pipes 25. Each of the parallel springs 24 is interposed between a lower surface of the shaft-mounting portion 23*a* of the fork holder 23 and an upper end of each of the parallel outer pipes 25 to absorb shocks caused by irregularities in the road and the like through the front wheel 12. Formed in a lower-end portion of each of the outer pipes 25 is a bearing portion 26*a* in which the front wheel 12 is rotatably mounted. Consequently, the front fork 15 resiliently supports the front wheel 12 so as to absorb the shocks transmitted through the front wheel 12, is rotatably mounted on the caster axle 14, and receives a control torque for steering the vehicle toy 10 as described later, which torque is produced in the steering unit 16**.

The steering unit 16 is provided with a steering mechanism 30 which produces a force which is applied to the front fork 15 as a control torque by the use of which the vehicle toy 10 is remotely controlled in its travel direction. The steering mechanism 30 is constructed of a ring-like permanent magnet (hereinafter simply referred to as the ring-like magnet) 31 and a magnetic coil 32, which is disposed inside the ring-like magnet 31 and controlled by applications of electric current issued from the receiver 19. Both the ring-like magnet 31 and the magnetic coil 32 are housed in the casing 33 in which is provided a control torque transmission resilient member or means in the form of a torsion spring 34. The casing 33 is mounted in the front portion of the vehicle body frame 11. Torsion spring 34 provides a resilient coupling between magnetic coil 32 of steering mechanism 30 and the front fork 15 through fork holder 23 resiliently applying the control torque to the front fork 15.

Figure 6:
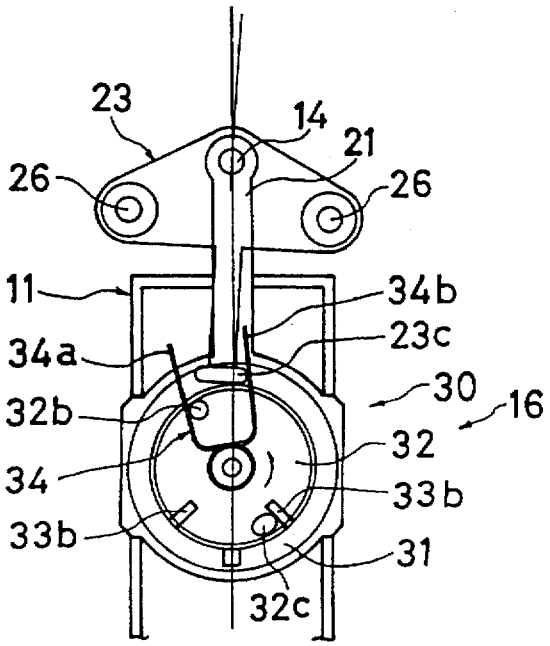
FIG. 6 is a view illustrating the steering system of the first embodiment of the present invention when the vehicle toy begins to make a left turn.

A central axle **32*a* is provided in a central portion of a lower area of the magnetic coil 32 to protrude downward, in which lower area an operation pin 32*b* and a stopper pin 32*c* are further provided so as to be diametrically opposed to each other in arrangement and protrude downward. The ring-like magnet 31 has its center axis arranged in parallel with the caster axle 14, and is fixedly mounted in the casing 31. The magnetic coil 32 has its central axle 32*a* inserted into a protruding bearing portion 33*a* of the casing 33 so as to be rotatably mounted in the casing 33. As shown in FIG. 6, a pair of stopper portions 33*b* of the casing 33 are symmetrically arranged with respect to a longitudinal center line of the vehicle body frame 11 so as to restrict rotation of the magnetic coil 32 within a predetermined angular range. Further mounted on the bearing portion 33*a* of the casing 33** is the torsion spring 34 which assumes a substantially U-shaped form provided with a left leg portion 34*a* and a right leg portion 34*b*, as viewed in FIG. 4. The operation pin 32*b* of the magnetic coil 32 is disposed between these leg portions 34*a* and 34*b* of the torsion spring 34. Also disposed between these leg portions 34*a* and 34*b* of the torsion spring 34 is the abutting portion 23*c* of the fork holder 23, which engages with front areas of these leg portions 34*a*, 34*b* in operation. Incidentally, in FIG. 4, the arrow D shows a travel direction of the vehicle toy 10.

As shown in FIGS. 1 and 3, the electric rear-wheel drive 17 of the vehicle toy 10 is constructed of: a drive motor 41; a speed-reduction unit 42 constructed of a gear train driven by the drive motor 41; and a drive casing 43 housing both the drive motor 41 and the speed-reduction unit 42 therein. The drive casing 43 is partitioned into two casing areas 43*a*, 43*b*; the first one 43*a* for housing the drive motor 41 therein; and the second one 43*b* for housing the speed-reduction unit 42 therein. The first casing area 43*a* is rotatably mounted on the rear portion of the vehicle body frame 11 and resiliently supported by the buffer spring 22, which absorbs shocks caused by irregularities in the road and the like through the rear wheel 13. The second casing area 43*b* extends rearward from the first casing area 43*a*, as shown in FIG. 1, and rotates with the first casing area 43*a*. A drive shaft 44 is provided in a final gear of the speed-reduction unit 42, on which drive shaft 44 the rear wheel 13 is fixedly mounted. In a presently contemplated embodiment, the drive train has 36:10, 36:18, and 56:18 reduction gears to produce a total reduction of 22.4:1.

As seen in FIG. 1, the power source 18 supplies electric current to each of the receiver 19, drive motor 41, steering mechanism 30 and the like, and is detachably mounted in the central portion of the vehicle body frame 11 through a power source lock unit 45.

As seen in FIGS. 1 and 2, the auxiliary wheel unit 20 is provided with the pair of auxiliary wheels 53 which contact the ground when the vehicle toy 10 leans sideward from the vertical by a predetermined angle. Namely, the auxiliary wheel unit 20 is constructed of: a pair of mounting-bracket boss members 51 rotatably mounted on opposite sides of the central portion of the vehicle body frame 11 so as to be disposed in lower areas on the opposite sides thereof, each of which boss members 51 assumes a substantially L-shaped form; a pair of torsion springs 52 each of which resiliently and rotatably supports each of the boss members 51; and the pair of the auxiliary wheels 53 each of which is rotatably mounted on a free-end axle portion of each of the boss members 51. Preferably, the auxiliary wheels 53 are arranged to contact the ground when the vehicle toy 10 leans sideward from the vertical by a predetermined angle, for example, by an angle of 30 degrees. The wheels may be set to contact the ground when the vehicle toy 10 leans sideways from the vertical at a predetermined angle other than 30 degrees and it will be appreciated that the auxiliary wheels could further be mounted to permit selective setting of the angle of the vehicle toy at which the wheels 53 contact the ground. For example, each member 51 may be mountable to unit 20 in any of a plurality of discrete angular orientations, for example, by being keyed with any of a plurality of angularly arranged slots on unit 20, such that each wheel 53 might be selectively set at a first angle, which permits the easiest control of the vehicle toy, a second angle which permits more vehicle lean but, nevertheless, still permits the auxiliary wheels to support the vehicle toy at least when the toy is at rest, and a third highest angle, with the auxiliary wheel so high that the auxiliary wheel cannot support the vehicle toy while it is at rest.

Now, operation of the vehicle toy 10 of the present invention will be described with reference to the drawings in which FIGS. 5–8 show operation of the steering unit 16 and FIGS. 9–12 show rear views of the vehicle toy 10 corresponding to the operation of the steering unit 16.

Figure 15:
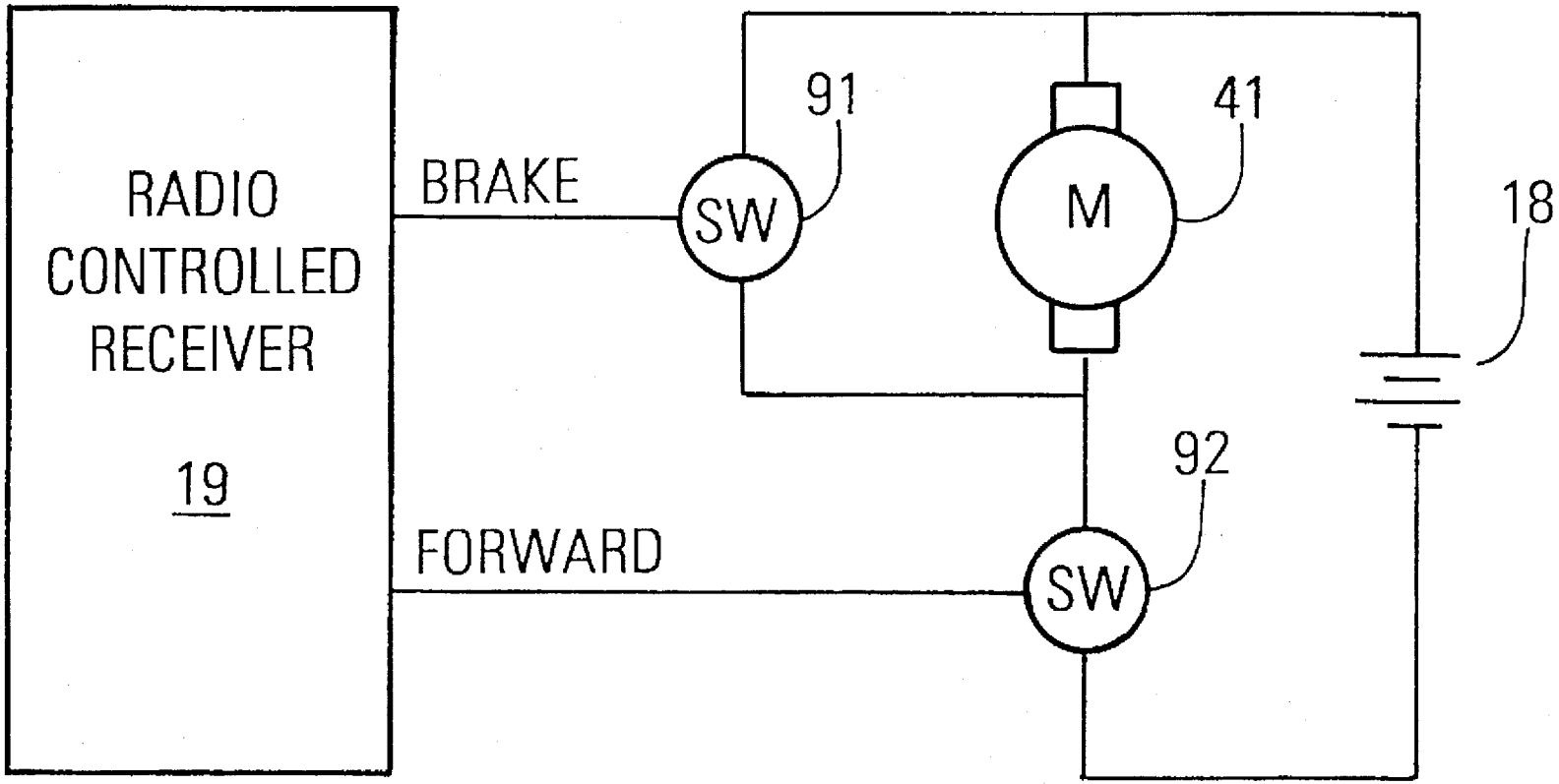
FIG. 15 is a schematic diagram illustrating the forward drive and braking circuitry employed in the vehicle toy of FIG. 1.

When a radio-control transmitter (conventional and not shown) emits a signal for actuating the drive motor 41, the receiver 19 receives the signal and permits the power source 18 to supply electric current to the drive motor 41 so that the vehicle toy 10 begins to travel. More particularly, and as shown in FIG. 15, it is preferable that the motor 41 be placed in series with a switch 92, that the power source 18 be placed across the motor 41 and switch 92, and that the switch be operable according to a FORWARD signal initiated by the receiver 19. Accordingly, when the receiver 19 causes the FORWARD signal to be applied, the switch 92 closes and the motor 41 is driven by electrical current from the power source 18.

Likewise, when the radio-control transmitter (not shown) emits a signal for braking the vehicle toy 10, the receiver 19 receives the signal and prohibits the power source 18 from supplying electric current to the drive motor 41 by terminating the FORWARD signal to open the switch 92. In addition, and as shown in FIG. 15, it is also preferable that a switch 91 be placed across the motor 41 and that the switch be operable according to a BRAKE signal initiated by the receiver 19. Accordingly, when the receiver 18 causes the BRAKE signal to be applied, the switch 92 closes and the motor 41 is shorted out. As should be understood, the shorted motor causes a back EMF that exerts a drag on the speed-reduction unit 42 and the rear wheel 13 to dynamically brake the vehicle toy 10. It will be appreciated that the BRAKE signal cab be the reverse drive signal of a conventional radio control toy vehicle transmitter (not depicted).

Preferably, the switches 91, 92 are transistors or the like. As one skilled in the art will recognize, though, other switching devices may be employed as the switches 91, 92 without departing from the spirit and scope of the present invention. For example, such other switching devices may include opto-isolators, switching transformers, and the like. Also preferably, appropriate circuitry (not shown) is provided with the motor 41 and the switches 91, 92 to condition the FORWARD and BRAKE signals used to control the switches 91, 92 and to condition the application of electric current to the motor 41 by the power source 18.

Figure 5:
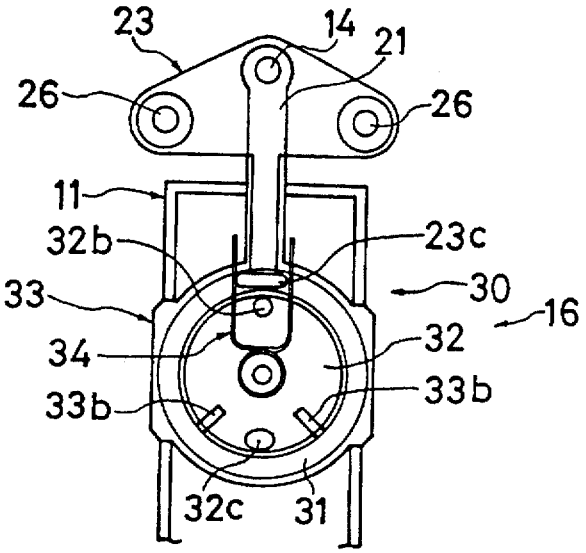
FIG. 5 is a view illustrating the steering system of the first embodiment of the present invention in operation when the vehicle toy travels straight.

The operation of the toy vehicle 10 during travel will now be described. To keep the toy vehicle 10 traveling on a straight course, the vehicle toy 10 has the magnetic coil 32 of the steering mechanism 30 thereof supplied with no electric current, so that the magnetic coil 32 tends to remain stationary to assume the position as shown in FIG. 5 due to the centering forces applied by torsion spring 34 from the front fork. In this condition, when the vehicle toy 10 leans to the left (for example), the front wheel 12 also leans to the left to produce a force pushing the vehicle body frame 11 to the right due to a so-called caster effect, so that the vehicle toy 10 recovers its balance. When the vehicle toy 10 leans to the right, the front wheel also leans to the right to produce a force pushing the vehicle body frame 11 to the left due to the caster effect, so that the vehicle toy 11 recovers its balance. As a result, the vehicle toy 10 travels in a straight path.

Figure 10:
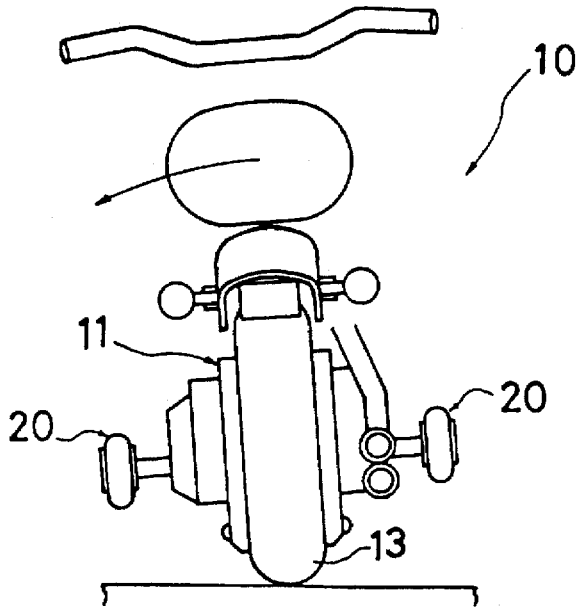
FIG. 10 is a rear view of the vehicle toy corresponding to FIG. 6.

In making a left turn, the vehicle toy 10 receives a left-turn signal emitted from the radio-control transmitter (not shown). As a result, the receiver 19 of the vehicle toy 10 issues a signal causing the power source 18 to supply electric current to the magnetic coil 32, so that the magnetic coil 32 turns counterclockwise until its stopper pin 32*c* abuts against the stopper portion 33*b* of the casting 33. As a result, the operation pin 32*b* of the magnetic coil 32 abuts against and applies a force to the left leg portion 34*a* of the torsion spring 34 to cause the torsion spring 34 to rotate counterclockwise, so that an inner surface of the right leg portion 34*b* of the torsion spring 34 abuts against the abutting portion 23*c* of the fork holder 23, where the force is resiliently applied by the spring 34 to the fork holder 23 as a control torque through the holder 23 on the front fork 15. The fork holder 23 thus is rotated clockwise on the caster axle 14, as shown in FIG. 6. As a result, the front wheel 12 is slightly turned to the right to have the vehicle toy 10 lose its balance, so that the vehicle body frame 11 is subjected to a leftward centrifugal force, whereby the vehicle body frame 11 tends to fall to the left, as shown in FIG. 10.

Figure 7:
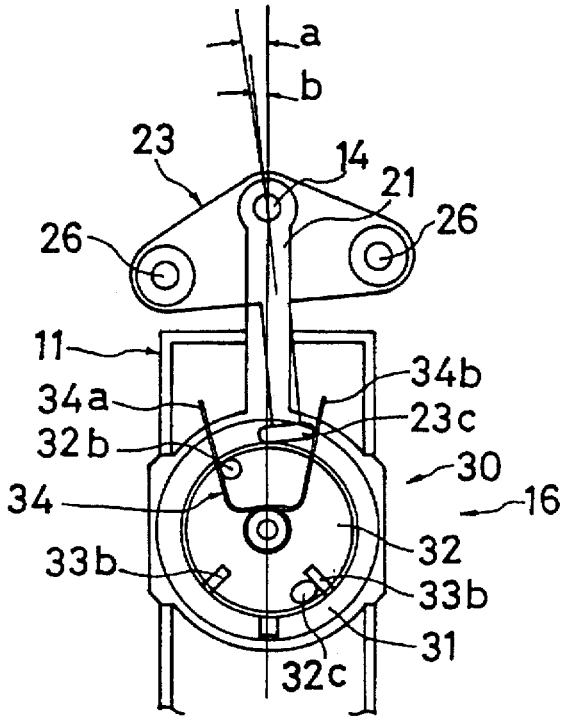
FIG. 7 is a view illustrating the steering system of the first embodiment of the present invention during the left turn.

As a result, the front wheel 12 is subjected to a force causing the front wheel 12 to turn to the left on the caster axle 14, so that the vehicle toy 10 leans leftward to make a left turn. In this condition, as shown in FIG. 7: the fork holder 23 rotates counterclockwise on the caster axle 14; the torsion spring 34 has the inner surface of its left leg portion 34*a* abut against the operation pin 32*b* of the magnetic coil 32, and has the inner surface of its right leg portion 34*b* abut against the abutting portion 23*c* of the fork holder 23, so that the torsion spring 34 has its leg portions 34*a*, 34*b* opened as a whole. Due to the presence of a resilient force exerted by the torsion spring 34, as shown in FIG. 7, an actual left-turn angle "b" of the front wheel 12 is slightly smaller than an apparent left-turn angle "a" corresponding to both the travel speed and the banking angle of the vehicle toy 10, so that the vehicle body frame 11 is continuously subjected to a force causing the vehicle toy 10 to fall to the left. As a result, the vehicle toy 10 continues its left turn even after the vehicle toy 10 reaches a predetermined banking condition in which its auxiliary wheels 53 are brought into contact with the ground as shown in FIG. 11.

Figure 8:
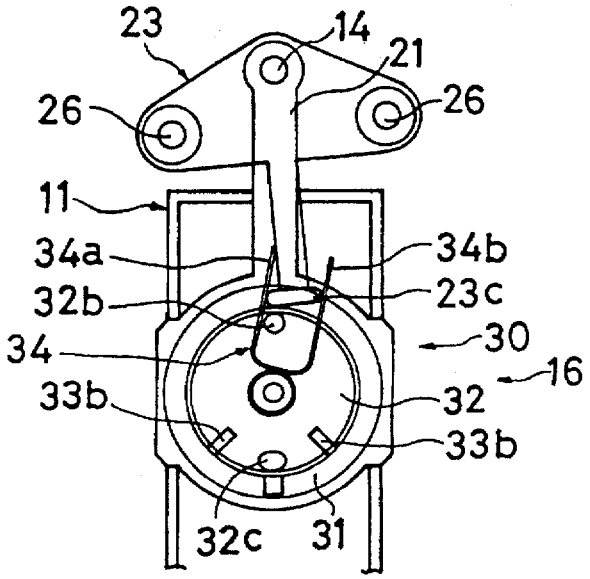
FIG. 8 is a view illustrating the steering system of the first embodiment of the present invention when the vehicle toy is in the process of completing the left turn and returning to straightforward travel.
Figure 9:
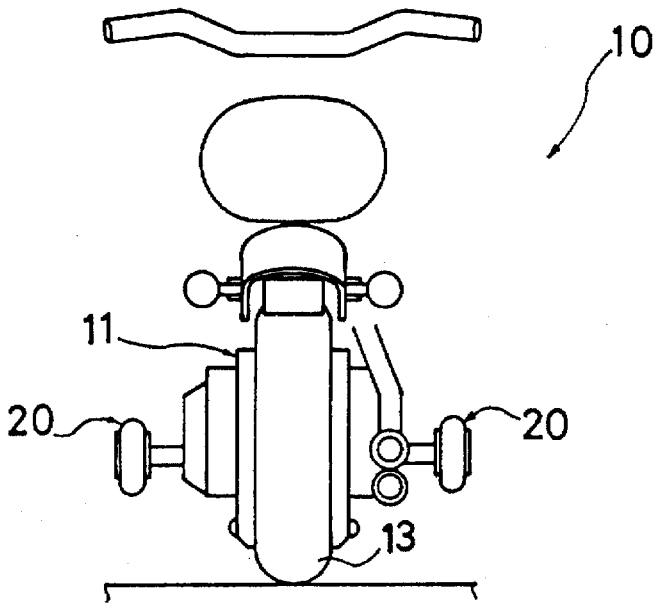
FIG. 9 is a rear view of the vehicle toy corresponding to FIG. 5.

To return the vehicle toy 10 to travel in a straight path, the radio-control transmitter (not shown) emits a signal for preventing the vehicle toy 10 from continuing the turn. Upon receipt of the above signal, the receiver 19 issues a signal for preventing the power source 18 from supplying the electric current to the magnetic coil 32 of the steering mechanism 30 so that the displacement force produced by the magnetic coil 32 is removed, as shown in FIG. 8, to permit the torsion spring 34 to return to its initial position, whereby the abutting portion 23*c* of the fork holder 23 is free from any external force. Consequently, since the force, which is exerted by the torsion spring 34 to have the actual angle "be" be smaller than the apparent angle "a", is removed, it is possible for the fork holder 23 to freely turn on the caster axle 14 so as to have the apparent angle "a" corresponding to the travel speed and the banking angle of the vehicle toy 10. Further, due to the caster effect, the vehicle toy 10 is subjected to a recovering force indicated by the arrow in FIG. 12 to return to its straight travel, as shown in FIG. 9.

In making a right turn, a right-turn signal is emitted by the radio-control transmitter (not shown). When the signal is received by the receiver 19, the receiver 19 issues a signal permitting the magnetic coil 32 to turn clockwise, so that the vehicle toy 10 makes the right turn in the same way as described above.

Figure 11:
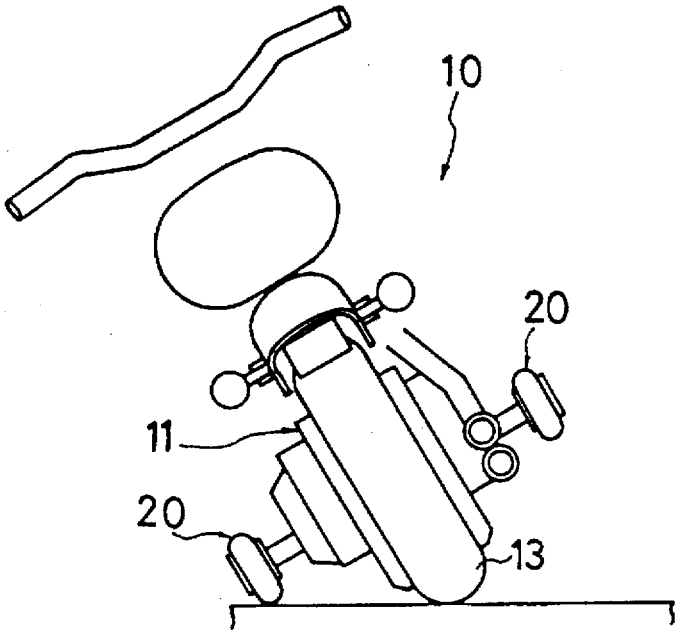
FIG. 11 is a rear view of the vehicle corresponding to FIG. 7.
Figure 12:
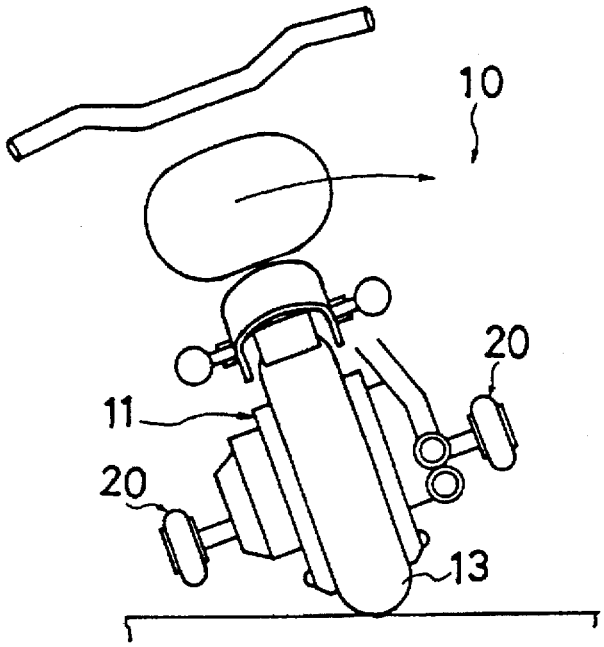
FIG. 12 is a rear view of the vehicle toy corresponding to FIG. 8.

As shown in FIG. 11, the auxiliary wheel unit 20 prevents the vehicle toy 10 from falling on the ground, and further permits the vehicle toy 10 to begin moving from a stationary condition. The torsion springs 52 (shown in FIG. 2), which serve as buffers, are provided for absorbing shocks caused by irregularities in the road and the like through the auxiliary wheels 53 (also shown in FIG. 2).

As described above, when the vehicle toy 10 makes turns by the use of the steering system of the present invention, it suffices to apply a small control torque to the fork holder 23 of the vehicle toy 10 so as to have the vehicle toy 10 slightly lose its balance during its straight travel. Consequently, in making turns, the vehicle toy 10 does not require a large control torque, which permits the vehicle toy 10 to use an electromagnet and like elements as its force generator. Further, in the vehicle toy 10 of the present invention, in making turns, since the vehicle toy 10 slightly loses its balance intentionally to produce and utilize a force having the vehicle toy 10 fall on the ground, it is possible to considerably improve the response of the steering system of the present invention.

Figure 13:
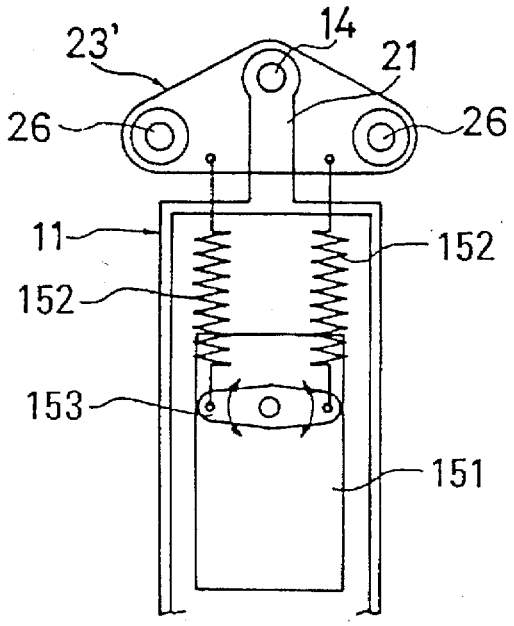
FIG. 13 is a view illustrating a second embodiment of the steering system of the present invention.
Figure 14:
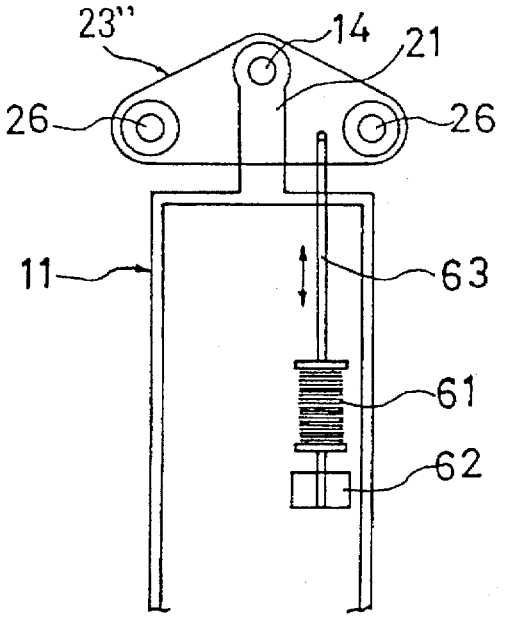
FIG. 14 is a view illustrating a third embodiment of the steering system of the present invention.

FIG. 13 shows a second embodiment of the steering unit of the present invention, and FIG. 14 shows a third embodiment of the steering unit of the present invention. Incidentally, in any of the second and the third embodiment of the steering unit of the present invention, parts similar to those of the first embodiment of the present invention are denoted by the same reference numerals and characters as those used in the first embodiment.

In the first embodiment of the present invention, the ring-like magnet 31 and the magnetic coil 32 serve as the steering mechanism 30 which produces the control force and the torsion spring 34 resiliently transmits or applies the control force to the front fork as a control torque. In contrast, in the second embodiment of the present invention, as shown in FIG. 13, the steering mechanism is constructed as a servo-motor 151 which produces the control force, and a pair of tension coil springs 152 are used as resilient members or means in place of the torsion spring 34 of the first embodiment to transmit the force and apply it to the front fork as a control torque. More particularly, the tension coil springs 152 are mounted between opposite ends of a swingable arm 153 and a pair of symmetrical positions of the fork holder 23', which positions are symmetrical with respect to a center line of the fork holder 23' passing through the caster axle 14 to resiliently couple the swingable arm 153 of the steering mechanism and fork 15 through fork holder 23'. In the second embodiment of the present invention having the above construction, in making a left turn, the swingable arm 153 of the servo-motor 151 is rotated clockwise to have the front wheel 12 turn slightly to the right to upset the balance of the vehicle and subject the vehicle to a leftward centrifugal force, causing the vehicle to fall to the left and generating a force causing the front wheel to then turn to the left as before. At this time, due to the presence of a resilient force exerted by one of the tension coil springs 152, as already described with reference to FIG. 7 in the first embodiment, an actual left-turn angle "b" (shown in FIG. 7) of the front wheel 12 is slightly smaller than an apparent left-turn angle "a" corresponding to both the travel speed and the banking angle of the vehicle toy 10 to fall to the left. As a result, the vehicle toy 10 continues its left turn as in the case of the first embodiment of the present invention. To return the vehicle toy 10 to its straight travel, the servo-motor 151 is powered back to its original "neutral" position, whereby the vehicle toy 10 returns to its straight travel (as shown in FIG. 9).

In the third embodiment of the present invention, as shown in FIG. 14, the torsion spring 34 of the first embodiment is replaced with an assembly of a solenoid 61 and a magnet 62. An operation rod 63 has one of its opposite ends connected with the magnet 62 and the other connected with a portion of the fork holder 23". In operation, electric current is applied to the solenoid 61 so as to have the solenoid 61 attract or repel the magnet 62, whereby the fork holder 23" is rotated on the caster axle 14. Due to the presence of such attracting or repelling force exerted by the assembly 61, 62 in place of the torsion spring 34, an actual left-turn angle "b" (shown in FIG. 7) of the front wheel 12 is slightly smaller than an apparent left-turn angle "a" corresponding to both the travel speed and the banking angle of the vehicle toy 10, so that the vehicle body frame 11 is continuously subjected to a force causing the vehicle toy 10 to fall to the left. As a result, the vehicle toy 10 continues its left turn as is in the case of the first embodiment of the present invention. The magnetic coupling between magnet 62 and solenoid 61 also provides a direct resilient coupling between the steering mechanism which produces the force applied as the control torque to the front fork through fork holder 23".

In each of the above embodiments of the present invention, it is possible to use any of the ring-like magnet, electromagnet, servo-motor, or the assembly thereof. Of course, it should be understood that one skilled in the art could accomplish modifications within the scope of the present invention, and accordingly the present invention should be measured from the following claims.

As described above, as for the steering system of the wheeled vehicle toy of the present invention, there is provided a servo-mechanism in the front portion of the vehicle body frame. The servo-mechanism produces the force which is resiliently applied to the front fork of the vehicle toy as a control torque to resiliently control the front fork in rotation. Consequently, during the straight travel, when the vehicle toy tends to fall to the left, the front wheel leans to the left to produce a force pushing the vehicle body frame to the right. In contrast with this, when the vehicle toy tends to fall to the right, the front wheel leans to the right to produce a force pushing the vehicle body frame to the left. As a result, the vehicle toy recovers its balance during the straight travel. In making turns, it suffices to apply a small control torque to the fork holder of the vehicle toy to have the toy slightly lose its balance during the straight travel, which permits an electromagnet to serve as the prime mover of the steering system of the present invention. Further, in making turns, since the vehicle toy utilizes the force having the toy lose its balance, the vehicle toy of the present invention is excellent in responsiveness of operation. As is clear from the above, the steering system of the present invention is small in the number of its components, easy in its assembly operations, and low in manufacturing costs and relatively light in weight. Reduced weight increases battery life, improves acceleration and steering responsiveness, reduces braking load and distance and reduces material and shipping costs. Simplicity should improve reliability and make the steering system more affordable in lower cost toys.

While the preferred embodiment of the present invention is described in terms of a two-wheeled remotely controlled toy vehicle, it will be appreciated that aspects of the invention could be applied to vehicles of three or more wheels. In particular, the steering invention could be applied to a three-wheeled vehicle such as a motorcycle with sidecar, preferably one with a flexible coupling to the mainframe of the motorcycle to permit the frame to lean to either side at least slightly. Alternatively, a tricycle-type motorcycle might be employed with a single front steering wheel and a pair of rear driven roadwheels. Preferably, the frame would be pivotally mounted to a rear wheel assembly including the rear wheels and the rear wheel drive unit so that the frame could pitch to either lateral side while connected with the rear drive unit. Also, it is not inconceivable that a four-wheeled vehicle might be provided by effectively pivotally coupling together, side by side, a pair of two-wheeled vehicles in a way which would again permit the main portions of the vehicle frames carrying the front wheels to pitch to either side by a pivotal coupling of the front wheels and frame(s) supporting the front wheels with a remaining rear drive portion of the vehicle, which would typically include at least two road wheels always in contact with the ground.

Other changes to the details of the disclosed preferred embodiment wheeled vehicle 10 will be apparent. For example, although a single auxiliary wheel unit 20 having a pair of auxiliary wheels 53 is disclosed, a pair of mirror image auxiliary wheeled units, each with a single auxiliary wheel could be provided on either side of the vehicle body frame 11 so as to provide a cavity within the frame between the units, for example, to accommodate a larger power supply or other components within the frame. Also, although auxiliary wheels are depicted as being parallel to the frame 11 and upright, it may be desirable to pitch the wheels 53 from the vertical by an amount equal to the pitch of the vehicle 10 from the vertical (e.g. 30°) when the auxiliary wheels come into contact with the ground so that the wheels 53 are perpendicular to a level, horizontal surface on which the toy vehicle is supported when it is pitched over onto the auxiliary wheel.

While the rear-wheel drive is described as including a speed reduction unit 42 coupled to the rear wheel 13 by means of a drive shaft 44, it will be apparent that the final gear of the reduction drive unit 42 could be formed or coupled directly with the rear wheel 13 to rotate with the wheel on a common axle provided where drive shaft 44 was provided. It further will be apparent that the gear-type speed-reduction unit 42 could also be driven in a reverse direction, if desired, and that a conventional reverse drive control could be provided in the vehicle unit to respond to the "BRAKE" signal or an equivalent to reverse the direction of current supply to the motor, rather than shorting out the motor, to positively drive the rear wheel in a reverse direction for slowing or stopping. It will further be appreciated that other types of control enhancements used with other radio control wheeled vehicles could similarly be applied to the preferred embodiment wheeled vehicle disclosed. For example, some hand controllers generate two separate forward direction signals, a conventional forward signal and a "TURBO" forward signal. This is typically accomplished by providing two separate contacts along the path of travel of the actuator generating the forward control signal to generate either of two separate forward control signals. In response to the conventional signal, the motor in the toy vehicle may be intermittently powered on a duty cycle. When the TURBO signal is received, the motor may be powered continuously.

While three indirect steering systems are disclosed it will be appreciated that a coil could be located directly on or over castor axle 14 to act directly upon the axle 14 or some portion of that axle as in a solenoid or that the axle 14 may be provided with an appropriate winding to act directly upon a surrounding ring-like magnet like the second and first embodiments, respectively. A resilient magnetic coupling would be generated between the two to apply a control torque directly but resiliently to the front fork. Of course a torsion spring coupling could also be provided if it is undesirable to operate magnetically directly on the castor axle 14.

From the foregoing description, it can be seen that the present invention comprises a new and useful wheeled vehicle toy. It will be appreciated by those skilled in the art that other changes could be made to the embodiments described above without departing from the broad inventive concepts thereof. It is understood, therefore, that this invention is not limited to the particular embodiments disclosed, but it is intended to cover modifications within the spirit and scope of the present invention as defined by the appended claims.

We claim:

1. A radio-controlled wheeled vehicle toy comprising:

a generally longitudinal vehicle body frame;

a caster axle mounted on a front end of the vehicle body frame and tilted backward from vertical;

a front fork rotatable on the caster axle and rotatably supporting a front vehicle wheel, said front fork having a centered position, allowing the vehicle to travel straight;

a rear-wheel drive drivingly coupled with a rear vehicle wheel;

a radio-control receiver and an electric power source both mounted to the vehicle body frame; and a steering system mounted in a front-end portion of the vehicle body frame and having:

a steering mechanism which produces a force to rotate the front fork based on a control signal issued from the receiver; and a resilient mechanism which resiliently applies the steering mechanism force as a control torque to the front fork, forcing the front fork from its centered position to turn the vehicle.

2. The vehicle toy as set forth in claim 1 wherein:

the steering mechanism includes a magnetic coil disposed inside a ring-like magnet to produce the force based on a control electric current issued from the receiver; and the resilient mechanism includes a U-shaped torsion spring having a pair of leg portions, the spring being mounted on a fixed portion of the vehicle body frame, the force produced in the magnetic coil being transmitted to one of the leg portions and thereafter being resiliently transmitted from the other of the leg portions to the front fork as the control torque.

3. The vehicle toy as set forth in claim 1 wherein:

the steering mechanism includes a servo-motor provided with a swingable arm to produce the force based on a control electric current issued from the receiver; and the resilient mechanism includes a pair of generally longitudinally oriented tension coil springs, each spring being disposed between an opposite lateral end of the swingable arm of the servo-motor and a respective opposite lateral portion of the front fork and being symmetrical with respect to the caster axle, to transmit the force produced by the magnetic coil to the swingable arm and resiliently to the front fork through the tension coil springs as the control torque.

4. The vehicle toy as set forth in claim 1 wherein the steering system includes a magnetic coil for being energized with a control electric current to produce one of a magnetic attracting force and a magnetic repelling force, a magnet positioned to be attracted and repelled by the magnetic coil, and a connecting rod coupling the magnet and the front fork, the attracting force and the repelling force produced between the magnetic coil and the magnet being resiliently transmitted to the front fork as the control torque.

5. A radio-controlled vehicle toy according to claim 1 further comprising:

a motor; and a switch positioned across the motor and operable according to a signal initiated by the receiver, the signal closing the switch and shorting the motor, the shorted motor exerting a drag on the rear wheel drive to effectively brake the vehicle toy.

6. A radio-controlled wheeled vehicle toy comprising:

a generally longitudinal vehicle body frame;

a caster axle mounted on a front end of the vehicle body frame and tilted backward from vertical;

a front fork rotatable on the caster axle and rotatably supporting a front vehicle wheel, said front fork having a centered position, allowing the vehicle to travel straight;

an electric drive coupled with a rear vehicle wheel;

a radio-control receiver and an electric power source both mounted to the vehicle body frame; and a steering system mounted in a front-end portion of the vehicle body frame and having:

a steering mechanism which produces a force based on a control signal issued from the receiver; and a resilient coupling located between the steering mechanism and the front fork which resiliently applies the force to the front fork as a control torque, forcing the front fork from its centered position to turn the vehicle.

7. The vehicle toy as set forth in claim 6 wherein:

the steering mechanism includes a magnetic coil disposed inside a ring-like magnet to produce the control torque based on a control electric current issued from the receiver; and the resilient coupling includes a U-shaped torsion spring having a pair of leg portions, the spring being mounted on a fixed portion of the vehicle body frame, so as to receive the force produced by the magnetic coil at one of the leg portions and to thereafter resiliently transmit the force from the other of the leg portions to the front fork as the control torque.

8. The vehicle toy as set forth in claim 6 wherein:

the steering mechanism includes a servo-motor provided with a swingable arm to produce the force based on a control electric current issued from the receiver; and the resilient coupling includes a pair of generally longitudinally oriented tension coil springs, each spring being disposed between an opposite lateral end of the swingable arm of the servo-motor and a respective opposite lateral portion of the front fork and being symmetrical with respect to the caster axle, the force produced in the magnetic coil being transmitted to the swingable arm and thereafter being resiliently transmitted to the front fork through the tension coil springs as the control torque.

9. The vehicle toy as set forth in claim 6 wherein the steering system includes a magnetic coil for being energized with a control electric current to produce one of a magnetic attracting force and a magnetic repelling force, a magnet located to be attracted and repelled by the magnetic coil, and a connecting rod resiliently coupling the magnet and the front fork.

10. The vehicle toy as set forth in claim 6 further comprising auxiliary wheels mounted on opposite sides of the vehicle body frame so as to be brought into contact with an underlying surface when the vehicle body frame leans laterally to a predetermined degree.

11. The vehicle toy as set forth in claim 10 wherein height of the auxiliary wheels on the opposite sides of the vehicle body is adjustable.

12. The vehicle toy as set forth in claim 6 wherein the electric drive includes an electric motor and a switch positioned across the motor and operable according to a signal initiated by the receiver, to closing and short the motor so as to exert a drag on the electric drive and brake the vehicle toy.

13. The vehicle toy as set forth in claim 6 wherein resilient coupling applies a control torque of a magnitude sufficient to rotate the fork to turn the front wheel to steer the vehicle.

14. The vehicle toy as set forth in claim 1 wherein said resilient mechanism applies a control torque of a magnitude sufficient to rotate the fork to turn the front wheel to steer the vehicle.

15. The vehicle toy as set forth in claim 1 further comprising:

auxiliary wheels mounted on opposite sides of the vehicle body frame so as to be brought into contact with an underlying surface when the vehicle body frame leans laterally.

16. A radio-controlled wheeled vehicle toy comprising:

a generally longitudinal vehicle body frame;

a caster axle coupled with a front end of the vehicle body frame and having a top end of the axle tilted backward from vertical;

a front wheel support rotatable on the caster axle and rotatably supporting a front vehicle wheel, said front wheel support having a centered position, allowing the vehicle to travel straight;

a rear-wheel drive drivingly coupled with a rear vehicle wheel;

a radio-control receiver and an electric power source both mounted to the vehicle body frame; and a steering system including:

a steering mechanism which produces a force to rotate the front wheel support based on a control signal issued from the receiver; and a resilient mechanism physically and functionally coupled between the steering mechanism and the front wheel support which resiliently applies the steering mechanism force to the front wheel support as a steering torque, forcing the front fork from its centered position to turn the front wheel and steer the vehicle.

* * * * *